US006705918B1

(12) United States Patent
Chang

(10) Patent No.: US 6,705,918 B1
(45) Date of Patent: Mar. 16, 2004

(54) EYE ASSEMBLY FOR TOY, STATIONERY OR ORNAMENT

(76) Inventor: Chin-Sung Chang, P.O. Box No. 6-57, Chung-Ho, Taipei 235 (TW)

( * ) Notice: Subject to any disclaimer, the term of this patent is extended or adjusted under 35 U.S.C. 154(b) by 0 days.

(21) Appl. No.: 10/366,621

(22) Filed: Feb. 14, 2003

(51) Int. Cl.[7] ..... A63H 3/38

(52) U.S. Cl. ..... 446/392; 446/343; 446/347; 446/351

(58) Field of Search ..... 446/392, 393, 446/342, 343, 344, 345, 347, 348, 351, 389

(56) References Cited

U.S. PATENT DOCUMENTS 2,828,581 A * 4/1958 Prupis
3,086,318 A * 4/1963 Brudney
3,091,893 A * 6/1963 Brudney et al.
4,842,566 A * 6/1989 Nagao ..... 446/345

* cited by examiner

*Primary Examiner*—Derris H. Banks
*Assistant Examiner*—Ali Abdelwahed
(74) *Attorney, Agent, or Firm*—Troxell Law Office PLLC

(57) ABSTRACT

An eye assembly for toys, stationery or ornaments includes an outer shell disposed and fixed with a mobile eyeball. The eyeball is provided with a mobile cover at the top thereof and at the inner side of the outer shell, and an eyelid cover at the front thereof for forming an eye structure. The eye structure appears vivid and appealing when being erected and lain by opening and closing the eye for that the internal mobile cover is situated at different positions relative to the eyeball.

4 Claims, 7 Drawing Sheets

EYE ASSEMBLY FOR TOY, STATIONERY OR ORNAMENT

BACKGROUND OF THE INVENTION (a) Field of the Invention

The invention relates to an eye structure for toys, stationery or ornaments, and more particularly, to a moving eye structure capable of opening and closing the eyelid thereof when being erected or lain down, thereby bringing vividness as the main characteristic of the invention.

(b) Description of the Prior Art

In prior toys (dolls, for instance), stationery or ornaments, animal eyes are frequently used as a part of the designs thereof, and such eye structure is generally a spherical structure made of color glass or plastic.

The eye structure serves as a motionless decoration that is in fact a schematic design lacking not only appeal but also innovation, and hardly gains consumers' favors in purchasing as a result. There is another type of eye structure commonly used in dolls; a piece of weight is provided at the bottom of the eyelid thereof, so that the eyelid drops due to the weight provided when the doll is lain down. Although the structure above capable of closing appears to be more lively than the former, the facade of the eye structure is yet flawed for that it perpetually remains still. In addition, the human eye structure is unsuitable for animals, thus adding another shortcoming to the overall.

SUMMARY OF THE INVENTION

Therefore, the object of the invention is to provide a moving eye structure to overcome the above shortcomings namely being dull and unattractive in appearance as well as being indelicate. The moving eye structure in accordance with the invention has a mobile cover as a mobile eyelid and an eyeball body for rotating around such that the eye structure strikes as artistic as a whole.

The invention comprises: a semi-spherical outer shell provided with an axis opening at the two terminals of the diameter at the opening thereof, respectively, a screw pillar at the center of the reverse side thereof for screwing or fixing onto a toy, and an insertion hole at the center of the interior thereof; a mobile cover in the shape of an appropriate arcuated body provided with a protruding tail axis at the two terminals thereof, respectively, an arcuated weight connected between the two tail axes that are fitted into the axis openings of the outer shell such that the mobile cover is situated at the inner side of the outer shell, and the weight is also hung and disposed at the interior of the outer shell due to center of gravity; an eyeball body provided with an insertion pole at the reverse side thereof for inserting and fitting the insertion pole into the insertion hole of the outer shell for further fastening; an eyelid cover in shape of an arcuated piece for covering the bottom front of the outer shell and disposed with a tail opening at the two terminals thereof, respectively, for interlocking with the tail axes at the mobile cover to achieve a complete eye structure.

DETAILED DESCRIPTION OF THE PREFERRED EMBODIMENTS

Figure 1:
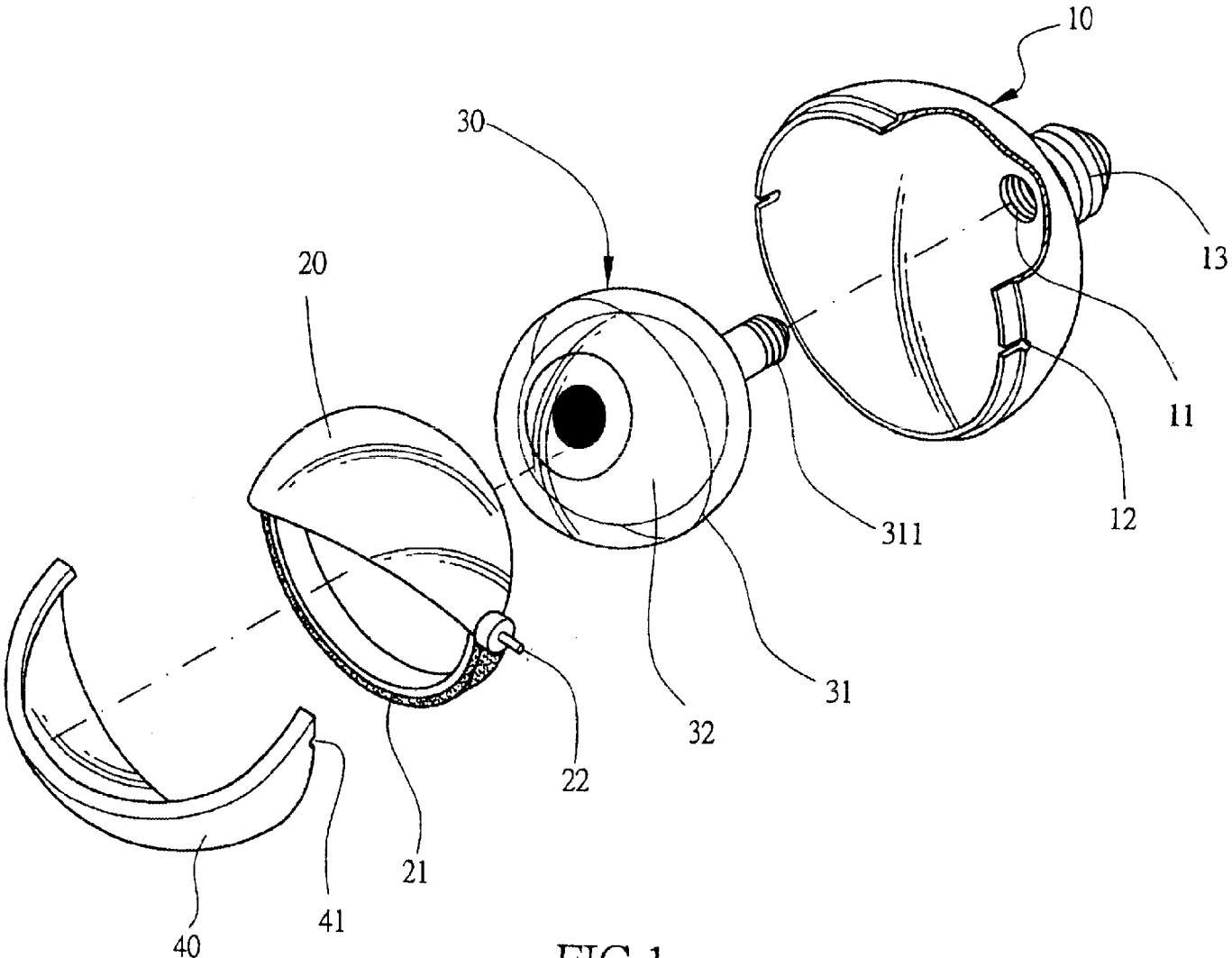
FIG. 1 shows an exploded schematic view in accordance with the invention.

To better understand the technical contents of the invention, scriptions shall be given with the accompanying drawings hereunder.

Referring to FIGS. 1, 2, 3, 4, and 5, the invention comprises:

- a semi-spherical outer shell 10 provided with an axle opening 12 at the two terminals of the diameter at the opening thereof, respectively; a screw pillar 13 at the center of the reverse side thereof for screwing or fixing onto a toy; and an insertion hole 11 at the center of the interior thereof;
- a mobile cover 20 in shape of an appropriate arcuated body provided with a protruding tail axis 22 at the two terminals thereof, respectively; and an arcuated weight 21 connected between the two tail axes 22 that are fitted into the axle openings 12 of the outer shell 10 such that the mobile cover 20 is situated at the inner side of the outer shell 10, and the weight 21 is also hung and disposed at the interior of the outer shell 10 due to center of gravity;
- an eyeball body 30 consisted of a transparent ball casing 31 provided with an insertion pole 311 at the reverse side thereof so that the insertion pole 311 is inserted and fitted into the insertion hole 11 of the outer shell 10 for fastening; an inner mobile cover 32 comparatively smaller in volume provided at the interior of the eyeball casing 31; a liquid 50 provided between the eyeball casing 31 and the inner mobile cover 32, so as to have the inner mobile cover 32 rotate amidst the liquid 50; a design such as a pupil 33 drawn in the front and a recess 320 disposed at the rear of the inner mobile cover 32; a protruding positioning pole 310 provided at the inner side of the eyeball casing 31 at a position corresponding to the recess 320 to have the positioning pole 310 extended into the recess 320, so that the angle of internal activity of the eyeball casing 31 is restrained (the shape of the recess 320 is preferably boat-shaped to have the rotation of the inner mobile cover 32 resemble that of a human eye); and
- an eyelid cover 40 in the shape of an arcuated piece disposed for covering the bottom front of the outer shell 10, and disposed with a tail opening 41 at the two terminals thereof, respectively, for interlocking with the tail axes 22 at the mobile cover 20 for a more secure structure.

Figure 2:
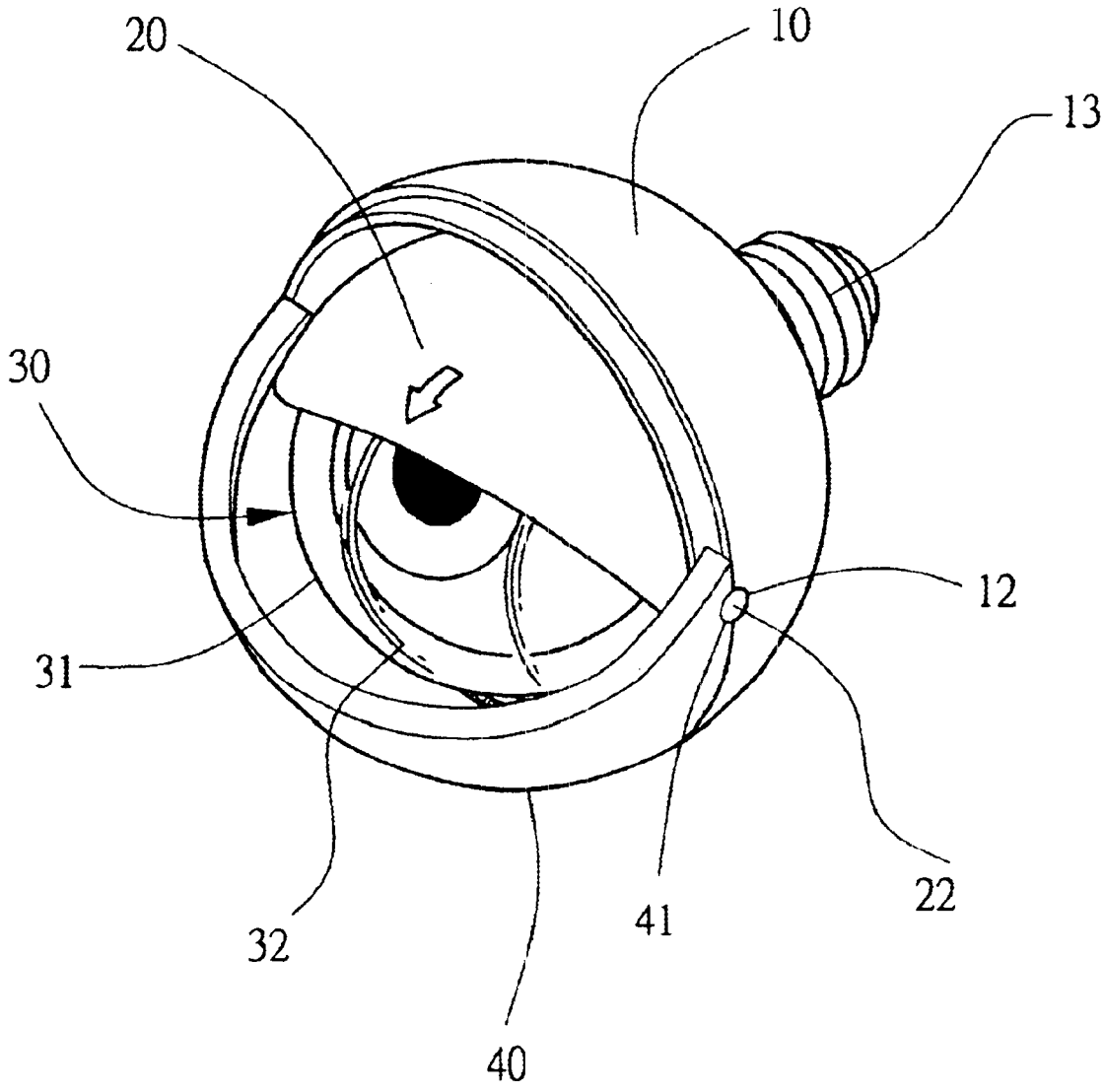
FIG. 2 shows a schematic view in accordance with the invention.
Figure 3:
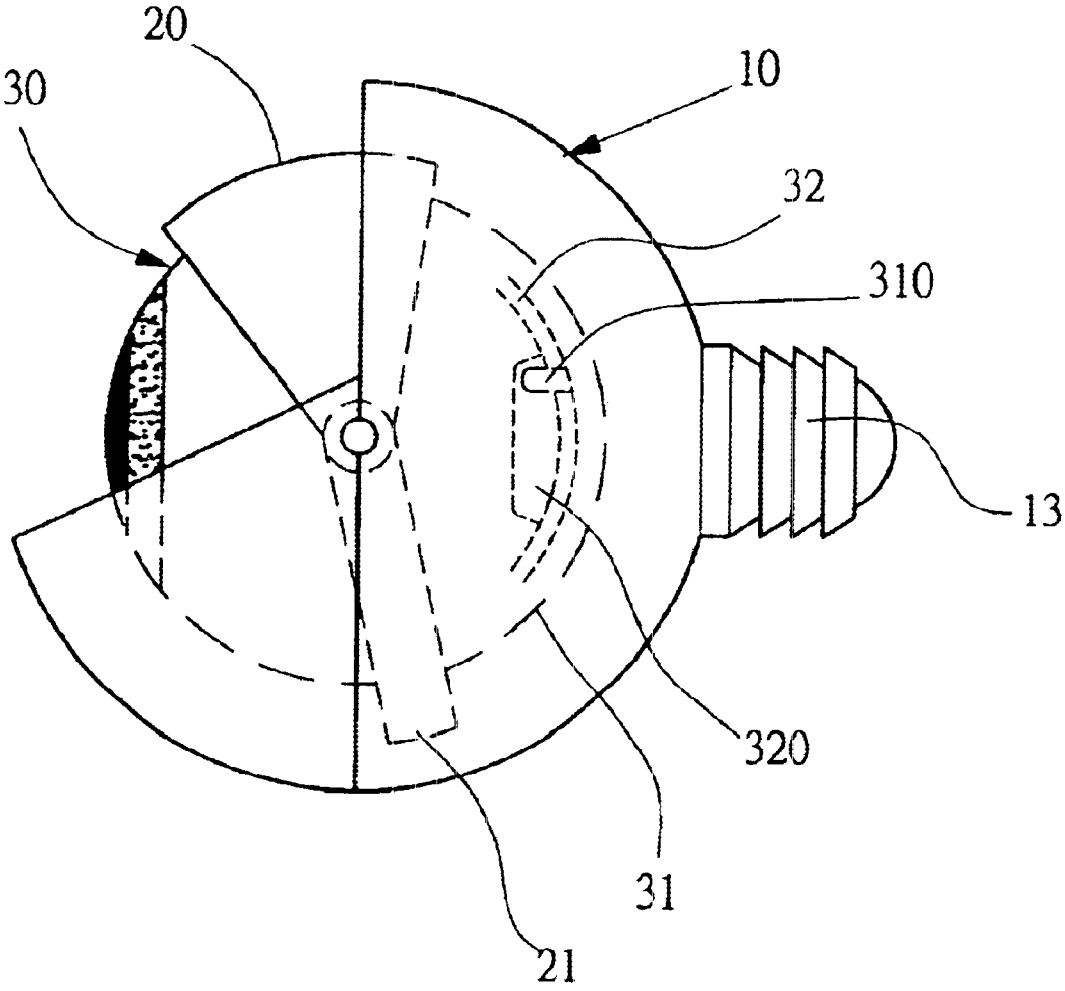
FIG. 3 shows a schematic view illustrating status 1 in accordance with the invention in use.
Figure 4:
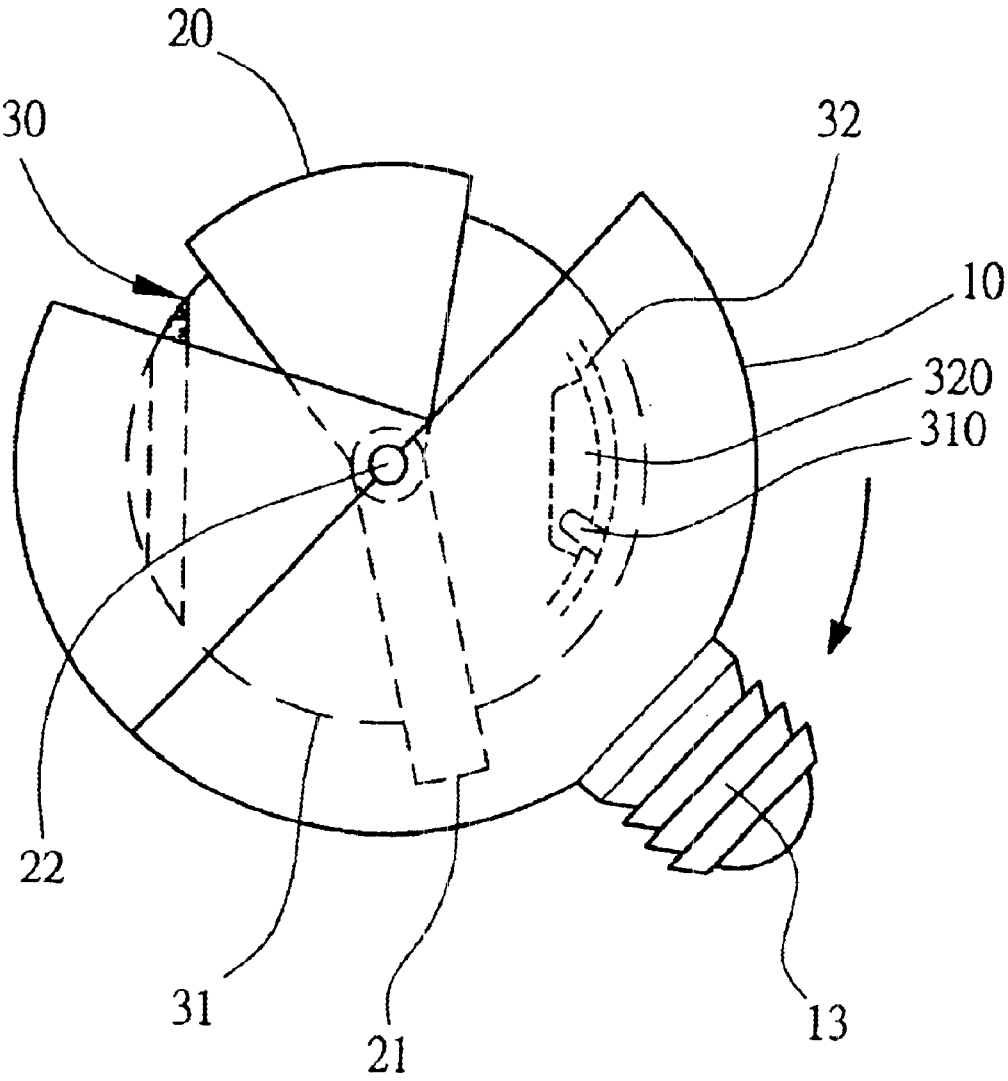
FIG. 4 shows a schematic view illustrating status 2 in accordance with the invention in use.
Figure 5:
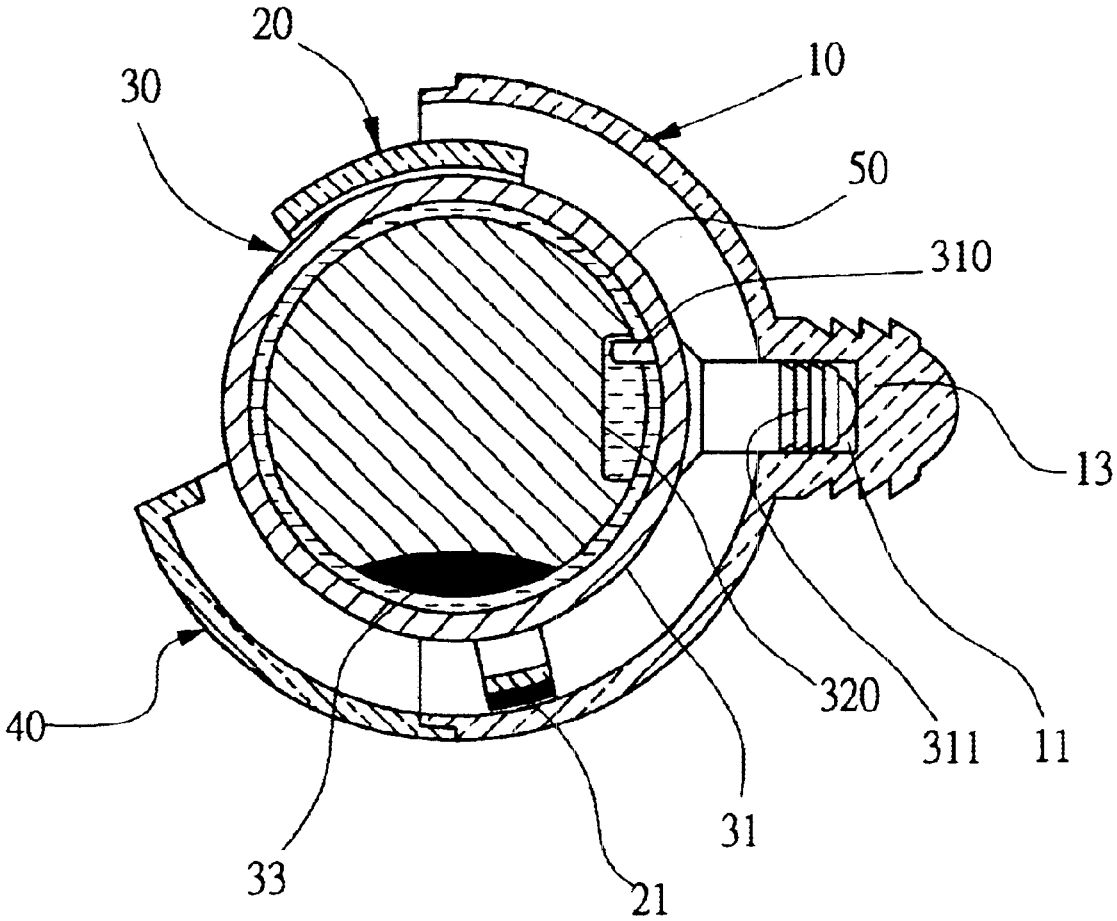
FIG. 5 shows a sectional schematic view in accordance with the invention.
Figure 6:
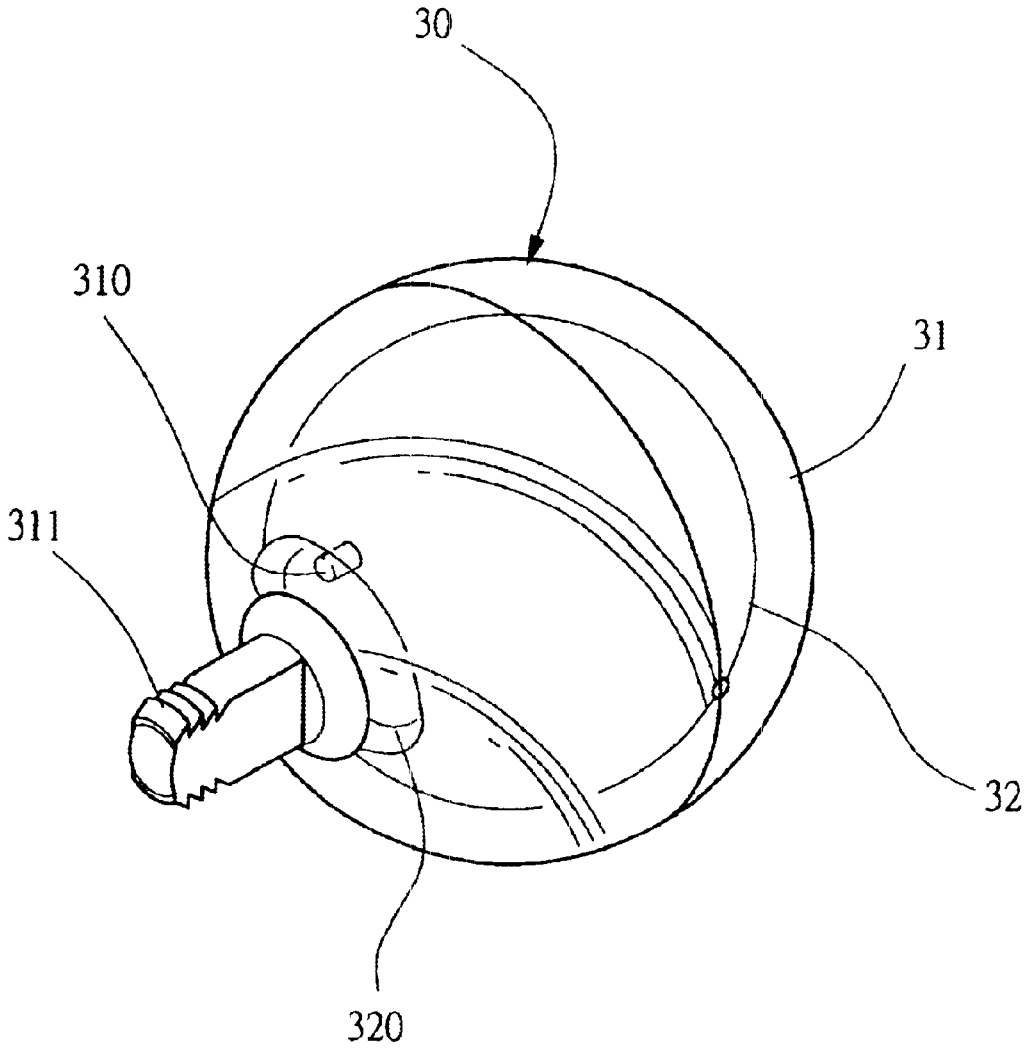
FIG. 6 shows a schematic view illustrating the rear of the eyeball in accordance with the invention.

Referring to FIGS. 2 and 3 illustrating the invention in an erect status, the mobile cover 20 is steadied at the top of the outer shell 10 due to the effects given by the weight 21. Referring to FIG. 4 illustrating the invention in a lain status, that is, when the outer shell 10 is toppled, the mobile cover 20 covers the vacant space between the outer shell 10 and the eyelid cover 40 to exactly block the front of the eyeball body 30, signifying an eye being closed by an eyelid in the front thereof. Again, by erecting the invention, the eye assembly restores to the status illustrated as in FIGS. 2 and 3.

Figure 7:
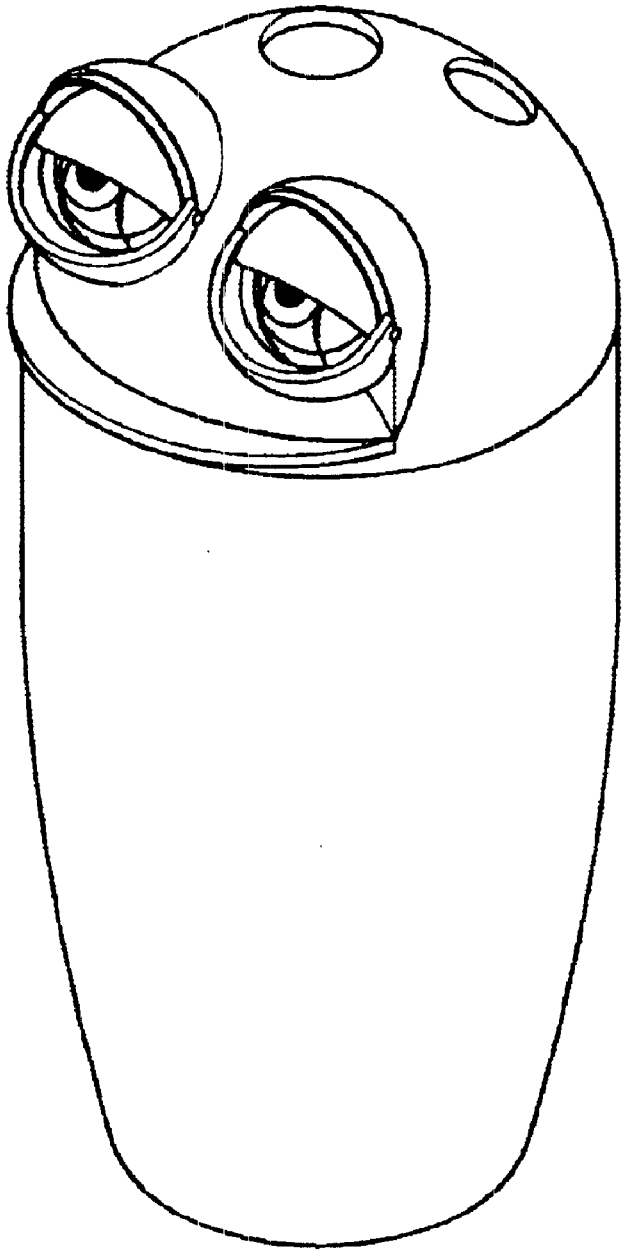
FIG. 7 shows a schematic view in accordance with the invention in application.

Referring to FIG. 7 showing the invention being applied in a pen container, the design appears like a big-eyed frog that gives vividness and appeal as the main characteristic of the invention.

In an eye assembly designed according to the invention, the structure is capable of closing and opening with liveliness and is particularly suitable for toy applications while also overcoming the problems of being inflexible or lack of mobility as described above.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. An eye assembly for toys, stationery or ornaments comprising:

a semi-spherical outer shell having an axle opening at each of two terminals of a diameter in an opening thereof, respectively; a screw pillar at a center of a reverse side thereof for screwing or fixing onto a toy; and an insertion hole at a center of an interior thereof;

an arcuate-body shaped mobile cover provided with a protruding tail axis at each of two terminals thereof, respectively; and an arcuate weight connected between the two protruding tail axes that are fitted into the axle openings of the outer shell such that the mobile cover is situated in the interior of the outer shell, and the weight is also hung and disposed at the interior of the outer shell due to center of gravity;

an eyeball body provided with a protruding positioning pole inserted into the insertion hole of the outer shell; and, an arcuate shaped eyelid cover covering a front of the outer shell and disposed with a tail opening at two terminals thereof, respectively, interlocking with the protruding tail axes of the mobile cover.

2. The eye assembly for toys, stationery or ornaments in accordance with claim 1, further comprising a transparent eyeball casing at an exterior of the eyeball body and interiorly of the mobile cover; a liquid provided between the eyeball casing and the eyeball body, so as to enable the eyeball body to rotate amidst the liquid; a design such as a pupil in a front of the eyeball body; a recess at a rear of the eyeball body; and, a protruding positioning pole provided at the interior of an eyeball casing at a position corresponding to the recess to have the positioning pole extended into the recess, so that an angle of the internal activity of the eyeball casing is restrained.

3. The eye assembly for toys, stationery or ornaments in accordance with claim 2, wherein a shape of the recess at the rear of the eyeball body is boat-shaped.

4. The eye assembly for toys, stationery or ornaments in accordance with claim 1, wherein at a center of a rear of the outer shell has a screw pillar for fastening onto a toy.

* * * * *